US008292763B2

(12) United States Patent
Huang et al.

(10) Patent No.: US 8,292,763 B2
(45) Date of Patent: Oct. 23, 2012

(54) COMPOSITION OF BASEBALL'S CORE

(76) Inventors: Fu-Chuan Huang, Tainan County (TW); Chin-Chen Ho, Taichung County (TW)

( * ) Notice: Subject to any disclaimer, the term of this patent is extended or adjusted under 35 U.S.C. 154(b) by 163 days.

(21) Appl. No.: 12/923,178

(22) Filed: Sep. 8, 2010

(65) Prior Publication Data

US 2012/0058844 A1 Mar. 8, 2012

(51) Int. Cl.
*A63B 37/02* (2006.01)

(52) U.S. Cl. ..... 473/600

(58) Field of Classification Search ..... 473/600–602, 473/598, 606
See application file for complete search history.

(56) References Cited

U.S. PATENT DOCUMENTS

| | | | | | |
|---|---|---|---|---|---|
| 1,609,493 | A | * | 12/1926 | Nye | 473/600 |
| 2,014,426 | A | * | 9/1935 | Dorogi | 473/606 |
| 2,081,531 | A | * | 5/1937 | Fegan | 473/602 |
| 2,138,004 | A | * | 11/1938 | Grau, Jr. | 473/600 |
| 2,275,374 | A | * | 3/1942 | De Beer | 473/601 |
| 2,278,292 | A | * | 3/1942 | Voit et al. | 473/602 |
| 2,645,487 | A | * | 7/1953 | Hawes | 473/601 |
| 3,069,170 | A | * | 12/1962 | Dillon, Jr. | 473/600 |
| 2007/0060426 | A1 | * | 3/2007 | Maziarz et al. | 473/605 |

* cited by examiner

*Primary Examiner* — Steven Wong

(57) ABSTRACT

A baseball includes a core comprised of coconut fiber, rubber, and solvent; and a cover sewn on the core by stitches. The coconut fiber having a predetermined percentage by weight is crushed, the rubber having a predetermined percentage by weight is gelled, the coconut fiber and the rubber are mixed with the solvent having a predetermined percentage by weight, and the mix is subjected to molding, heating, and cooling to produce the core.

3 Claims, 3 Drawing Sheets

Fig.. 4

COMPOSITION OF BASEBALL'S CORE

BACKGROUND OF THE INVENTION

1. Field of Invention

The invention relates to composition of baseballs and more particularly to composition of a baseball's core with improved characteristics.

2. Description of Related Art

A typical baseball is shown in FIG. 1 and comprises a spherical core 10 and two identical pieces of leather 21, 22 sewn to the core 10. One composition of the core 10 is cork and rubber mixed by solvent. The mix is next heated in a mold to form a sphere. The other composition of the core 10 is a high-density cork filled in a hollow rubber center, and the center wound in yarn or the like. Either composition has materials of cork and rubber. The cork is sourced from cork oak not wood. Composition of cork is mainly cork fiber. Cork oaks are endemic to southwest Europe. Cork oaks can be harvested every 9 to 12 years to produce cork. Cork is widely used in many applications (e.g., stoppers).

However, baseballs are poor in quality if their cores are composed of cork. This is because cork has a low density and weight and diameter tolerances are not acceptable. Thus, the need for improvement still exists.

SUMMARY OF THE INVENTION

It is therefore one object of the invention to provide a baseball comprising a core comprised of coconut fiber, rubber, and solvent; and a cover sewn on the core by stitches, wherein the coconut fiber having a predetermined percentage by weight is crushed, the rubber having a predetermined percentage by weight is gelled, the coconut fiber and the rubber are mixed with the solvent having a predetermined percentage by weight, and the mix is subjected to molding, heating, and cooling to produce the core.

In one aspect of the invention the predetermined percentage by weight of the coconut fiber is 40% to 70%, the predetermined percentage by weight of the rubber is 25% to 55%, and the predetermined percentage by weight of the solvent is 1% to 2%.

In another aspect of the invention the core further comprises sawdust having a predetermined percentage by weight, and wherein the predetermined percentage by weight of the coconut fiber is 25% to 55%, the predetermined percentage by weight of the rubber is 25% to 55%, the predetermined percentage by weight of the solvent is 1% to 2%, and the predetermined percentage by weight of the sawdust is 10% to 35%.

By utilizing the invention, the following advantages and characteristics are obtained and realized. The core has increased density. Weight and diameter of the core can be precisely controlled. Quality is greatly improved. Structural strength is greatly increased. Impact resistance is greatly improved. Coconut fiber is sourced from the fibrous husk of coconut which is a reused material. This not only decreases burden to the environment but also decreases the manufacturing cost. It is highly competitive.

The above and other objects, features and advantages of the invention will become apparent from the following detailed description taken with the accompanying drawings.

BRIEF DESCRIPTION OF THE DRAWINGS

FIG. 4 is a pie chart illustrating a second composition of the baseball's core according to the invention.

DETAILED DESCRIPTION OF THE INVENTION

Figure 1:
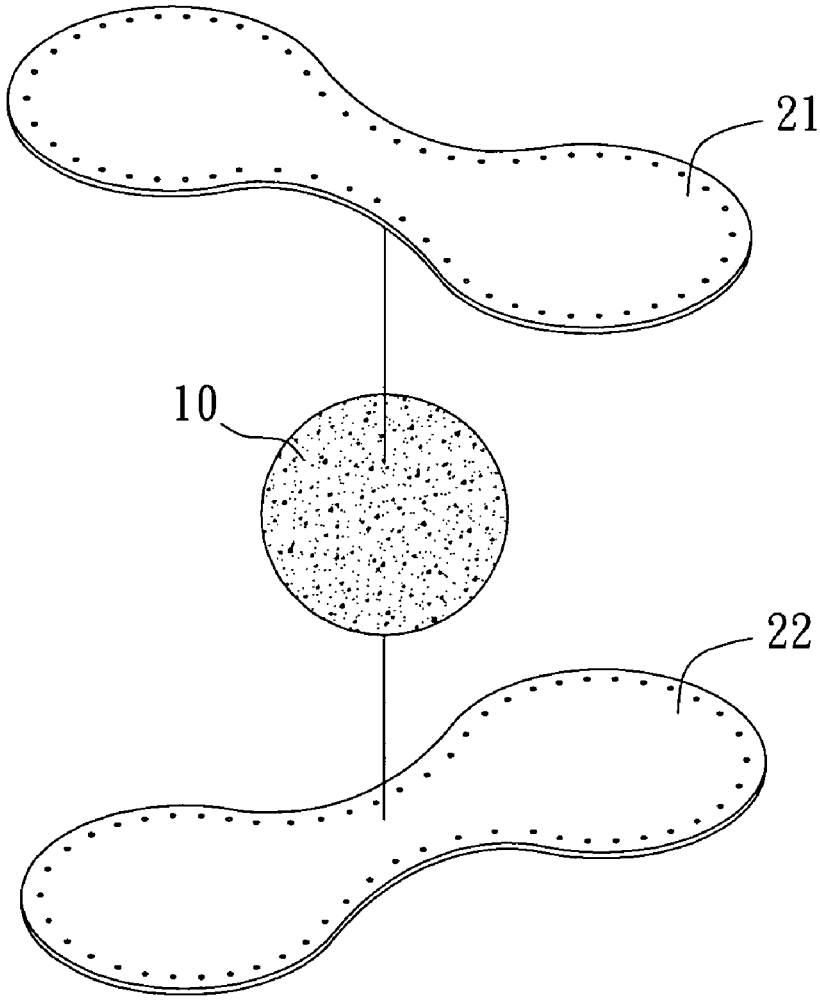
Fig. 1 Prior Art
FIG. 1 is an exploded perspective view of a typical baseball.
Figure 2:
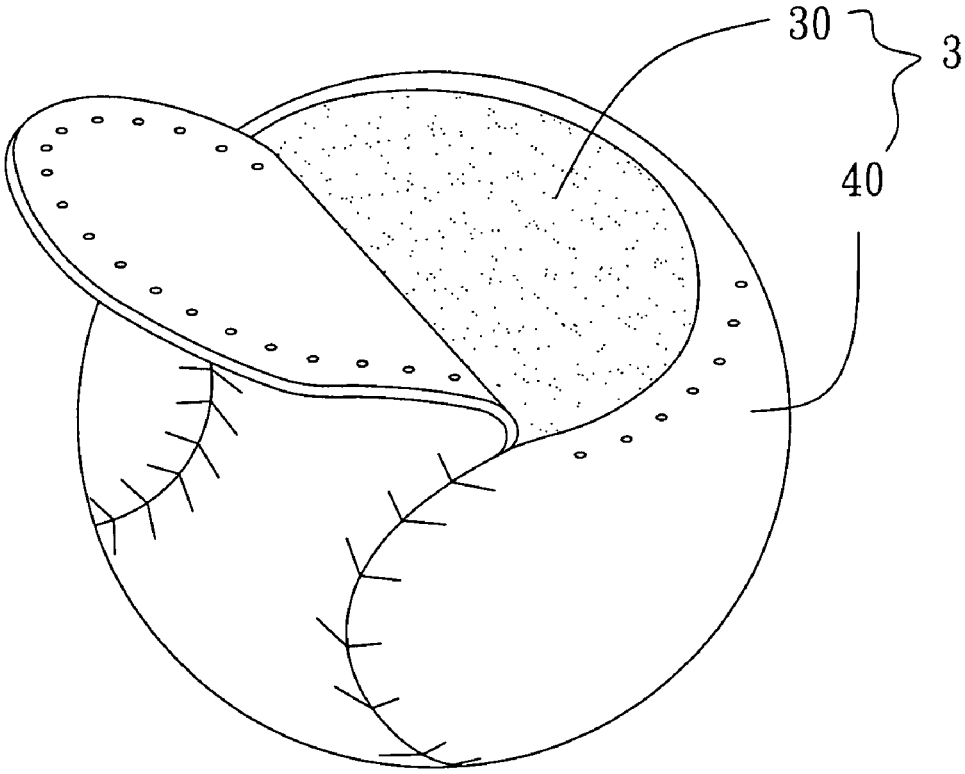
FIG. 2 is a perspective view of a baseball according to the invention with a portion of the cover being pilled.

Referring to FIGS. 2 and 4, a baseball 3 in accordance with the invention comprises a core 30 and a cover 40 sewn thereon by stitches as known in the art. The core 30 as the subject of the invention is discussed in detail below.

The core 30 is composed of coconut fiber 31, rubber 32, and solvent 33 in one composition. The other composition of the core 30 is coconut fiber 31, rubber 32, solvent 33, and sawdust 34. Both will be discussed later.

Coconut fiber 31 is comprised of cellulose, lignin, half-cellulose, and pectin with the remaining consisting of minerals in which cellulose has 46% to 64% by weight, lignin has 31% to 36% by weight, half-cellulose has 0.15% to 0.25% by weight, and pectin has 3% to 4% by weight. Cellulose, as the dominant composition of the coconut fiber 31, has properties of enhanced structural strength, moisture proof, refractory, and corrosion resistant.

Figure 3:
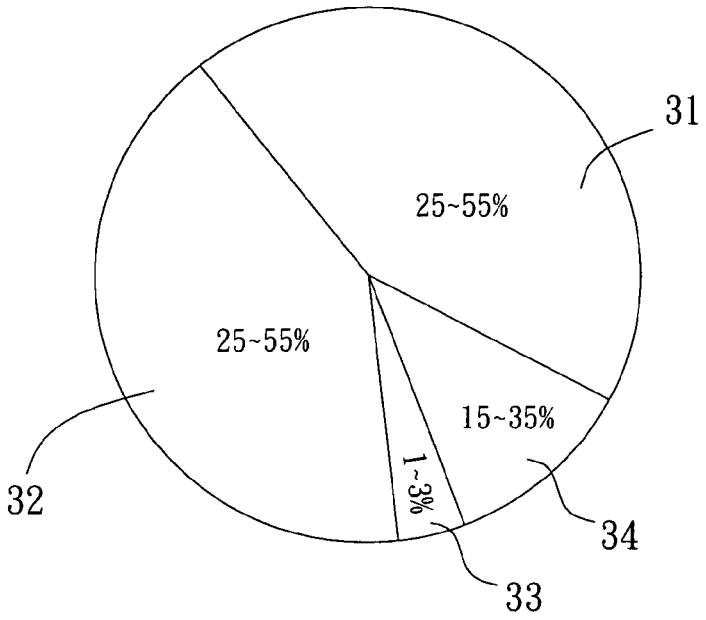
FIG. 3 is a pie chart illustrating a first composition of the baseball's core according to the invention.
Figure 3:
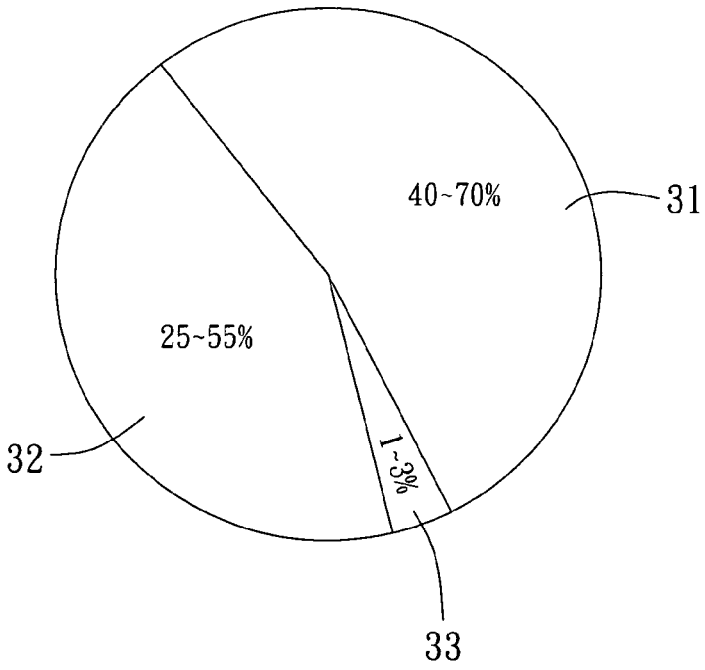

In the first composition of the core 30 shown in FIG. 3, the core 30 is composed of coconut fiber 31, rubber 32, and solvent 33 in which the coconut fiber 31 has 40% to 70% by weight, the rubber 32 has 25% to 55% by weight, and the solvent 33 has 1% to 2% by weight.

In the manufacturing processed, crushed coconut fiber 31 having 59% by weight and gelled rubber 32 having 40% by weight are mixed with solvent 33 having 1% by weight. The mix is then poured into a spherical mold. Next, the mold is heated and then cooled to form a spherical core 30.

In the second composition of the core 30 shown in FIG. 4, the core 30 is composed of coconut fiber 31, rubber 32, solvent 33, and sawdust 34 in which the coconut fiber 31 has 25% to 55% by weight, the rubber 32 has 25% to 55% by weight, the solvent 33 has 1% to 2% by weight, and the sawdust 34 has 10% to 35% by weight.

In the manufacturing processed, crushed coconut fiber 31 having 38% by weight, gelled rubber 32 having 40% by weight, and sawdust 34 having 21% by weight are mixed with solvent 33 having 1% by weight. The mix is then poured into a spherical mold. Next, the mold is heated and then cooled to form a spherical core 30.

Advantages and characteristics of the invention are described below. The core 30 has increased density. Weight and diameter of the core 30 can be precisely controlled. Quality is greatly improved. Structural strength is greatly increased. Impact resistance is greatly improved. Coconut fiber is sourced from the fibrous husk of coconut which is a reused material. This not only decreases burden to the environment but also decreases the manufacturing cost. Thus, it is highly competitive.

While the invention has been described in terms of preferred embodiments, those skilled in the art will recognize that the invention can be practiced with modifications within the spirit and scope of the appended claims.

What is claimed is:

1. A baseball comprising:

a core comprised of coconut fiber, rubber, and solvent; and a cover sewn on the core by stitches, wherein the coconut fiber having a predetermined percentage by weight is crushed, the rubber having a predetermined percentage by weight is gelled, the coconut fiber and the rubber are mixed with the solvent having a predetermined percentage by weight, and the mix is subjected to molding, heating, and cooling to produce the core;

wherein the coconut fiber is comprised of cellulose, lignin, half-cellulose, and pectin with the remaining consisting of minerals in which cellulose has 46% to 64% by weight, lignin has 31% to 36% by weight, half-cellulose has 0.15% to 0.25% by weight, and pectin has 3% to 4% by weight.

2. The baseball of claim 1, wherein the predetermined percentage by weight of the coconut fiber is 40% to 70%, the predetermined percentage by weight of the rubber is 25% to 55%, and the predetermined percentage by weight of the solvent is 1% to 2%.

3. The baseball of claim 1, wherein the core further comprises sawdust having a predetermined percentage by weight, and wherein the predetermined percentage by weight of the coconut fiber is 25% to 55%, the predetermined percentage by weight of the rubber is 25% to 55%, the predetermined percentage by weight of the solvent is 1% to 2%, and the predetermined percentage by weight of the sawdust is 10% to 35%.

* * * * *